US011143005B2

(12) United States Patent
Dusterhoft et al.

(10) Patent No.: US 11,143,005 B2
(45) Date of Patent: Oct. 12, 2021

(54) ELECTRIC PUMP FLOW RATE MODULATION FOR FRACTURE MONITORING AND CONTROL

(71) Applicant: Halliburton Energy Services, Inc., Houston, TX (US)

(72) Inventors: Ronald Glen Dusterhoft, Katy, TX (US); Stanley V. Stephenson, Duncan, OK (US); Timothy Holiman Hunter, Duncan, OK (US); Joshua Lane Camp, Friendswood, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 100 days.

(21) Appl. No.: 16/524,713

(22) Filed: Jul. 29, 2019

(65) Prior Publication Data

US 2021/0032967 A1 Feb. 4, 2021

(51) Int. Cl.

| | |
|---|---|
| ***E21B 43/26*** | (2006.01) |
| ***E21B 43/12*** | (2006.01) |
| ***E21B 43/16*** | (2006.01) |
| ***E21B 43/267*** | (2006.01) |

(52) U.S. Cl.

CPC ..... *E21B 43/26* (2013.01); *E21B 43/128* (2013.01); *E21B 43/162* (2013.01); *E21B 43/267* (2013.01); *E21B 43/2607* (2020.05)

(58) Field of Classification Search

CPC ..... E21B 43/26; E21B 43/2607; E21B 43/267

See application file for complete search history.

(56) References Cited

U.S. PATENT DOCUMENTS

| | | | |
|---|---|---|---|
| 9,217,318 | B2 | 12/2015 | Dusterhoft et al. |
| 9,297,250 | B2 | 3/2016 | Dusterhoft et al. |
| 9,581,004 | B2 | 2/2017 | Ciezobka et al. |

(Continued)

FOREIGN PATENT DOCUMENTS

| | | | |
|---|---|---|---|
| WO | 2018/048415 | A1 | 3/2018 |
| WO | 2018/126106 | A1 | 7/2018 |

OTHER PUBLICATIONS

International Search Report and Written Opinion issued in related PCT Application No. PCT/US2019/044112 dated Apr. 24, 2020, 14 pages.

*Primary Examiner* — Tara Schimpf

(74) *Attorney, Agent, or Firm* — John Wustenberg; Baker Botts L.L.P.

(57) ABSTRACT

The systems and methods described herein are be used in controlling an injection treatment. An electric pump is used to provide variable modulation of the flow rate of a treatment fluid. Modulating the flow rate in real-time provides pressure diagnostics that can be used to improve fracture growth parameters, wellbore conditions, and well performance. A method of stimulating a wellbore, comprises of injecting, by an electric pump, one or more fluids downhole into the wellbore; producing, based on the one or more injected fluids, one or more fractures that extend from the wellbore into a subterranean formation; receiving, by one or more sensors, one or more measurements; modulating an injection flow rate of the one or more injected fluids; evaluating fracture growth parameters of the one or more fractures; and adjusting fracture complexity of the one or more fractures based on the evaluation of the fracture growth parameters.

20 Claims, 5 Drawing Sheets

(56) References Cited

U.S. PATENT DOCUMENTS

| | | | | |
|---|---|---|---|---|
| 2014/0262232 | A1 | 9/2014 | Dusterhoft et al. | |
| 2016/0265331 | A1 | 9/2016 | Weng et al. | |
| 2019/0106970 | A1 | 4/2019 | Oehring | |
| 2019/0249542 | A1* | 8/2019 | Madasu | E21B 43/14 |
| 2020/0056466 | A1* | 2/2020 | Mazrooee | E21B 43/267 |

* cited by examiner

ELECTRIC PUMP FLOW RATE MODULATION FOR FRACTURE MONITORING AND CONTROL

BACKGROUND

The present disclosure relates to systems and methods for treating subterranean formations through modulation of an electric pump.

Wells in hydrocarbon-bearing subterranean formations often require stimulation to produce hydrocarbons at acceptable rates. One stimulation treatment of choice is hydraulic fracturing treatments. In hydraulic fracturing treatments, a fracturing fluid, which can also function as a proppant carrier fluid, is pumped into a producing zone at a rate and pressure such that one or more fractures are formed and/or extended in the zone. Typically, proppant particulates suspended in a portion of the fracturing fluid are deposited in the fractures. These proppant particulates help prevent the fractures from fully closing so that conductive channels are formed and maintained such that the produced hydrocarbons can flow at economic rates.

Existing hydraulic fracturing equipment has required the need to utilize transmissions to achieve a range of flow rate and pressure requirements for high pressure pumps. This provides difficulty in making large changes to flow rate without having to shift gears while pumping under high pressure conditions. Gear shifts at high pressure conditions can reduce the useful life cycle of the transmission due to overheating and placing excessive loads on the clutches. As a result, most injection rates are held constant to minimize wear on the equipment.

BRIEF DESCRIPTION OF THE DRAWINGS

These drawings illustrate certain aspects of some of the embodiments of the present disclosure and should not be used to limit or define the claims.

Figure 1:
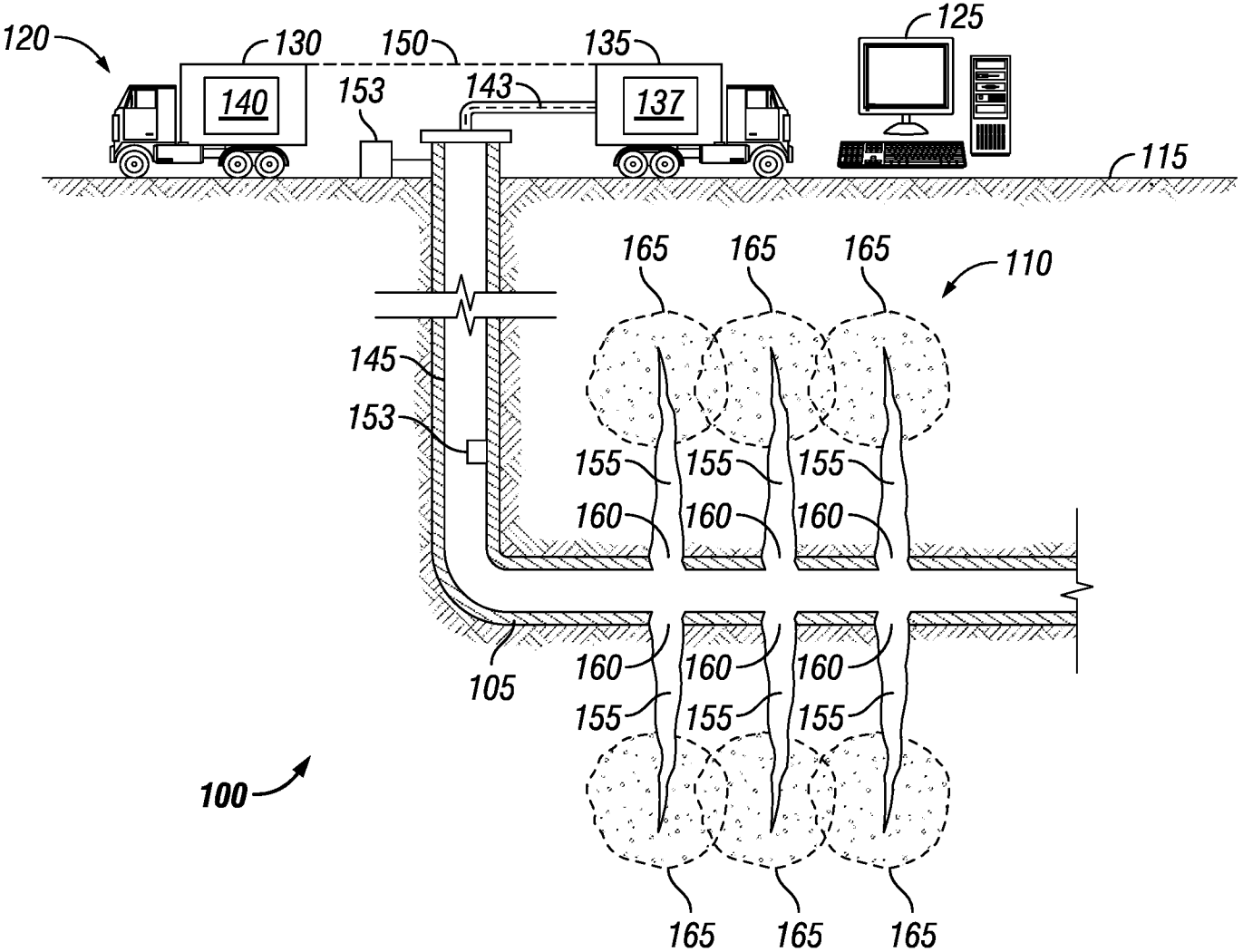
FIG. 1 illustrates a well system in a subterranean formation, in accordance with one or more embodiments of the present disclosure.

While embodiments of this disclosure have been depicted, such embodiments do not imply a limitation on the disclosure, and no such limitation should be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure provides systems and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, and the like. In one or more embodiments, a treatment fluid may be introduced into a subterranean formation. In one or more embodiments, the treatment fluid may be introduced into a wellbore that penetrates the subterranean formation. In one or more embodiments involving fracturing treatments, a treatment fluid may be introduced at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiments, a treatment fluid may be introduced at a pressure sufficient to create or enhance one or more fractures within the formation, and one or more of the treatment fluids comprising a proppant material subsequently may be introduced into the formation.

In one or more embodiments, the systems and methods disclosed herein may be used to improve or optimize hydraulic fracture treatments. For example, hydraulic fracture treatments may be designed for multi-stage horizontal well completions or other types of completions in unconventional reservoirs or other types of subterranean formations. Present systems and methods may be used to provide validation (for example, in real time during an injection treatment, or post-treatment) to ensure that the desired treatment properties are achieved.

In one or more embodiments, a target pressure may be determined. The target pressure may refer to an optimal, favorable, or otherwise designated value or range of values of the net treating pressure to be applied downhole. In the context of an injection treatment, the net treating pressure may indicate the extent to which fluid pressure applied to the subterranean exceeds rock closure stress (for example, the minimum horizontal stress). As such, a target pressure may indicate a desired net treating pressure to be applied to the subterranean formation by an injection treatment. The actual pressure may be observed during the injection treatment, and the fluid injection can be modified (for example, by increasing or decreasing fluid pressure) when the actual pressure falls outside (above or below) a target range.

The systems and methods described herein may be used in controlling an injection treatment. For example, the injection treatment may be modified by modulating the flow rate of the treatment fluid with an electric pump. Without limitations, the amplitude, frequency, and rate function may be varied to enable variable modulation. Modulating the flow rate in real-time may provide pressure diagnostics that can be used to improve fracture growth parameters (near the wellbore and far field growth), wellbore conditions, and well performance. In one or more embodiments, the electric pump may be actuated to increase or decrease the flow rate of the treatment fluid in order to maximize the production potential of the subterranean formation through controlling fracture growth.

In one or more embodiments of the present disclosure, an environment may utilize an information handling system to control, manage or otherwise operate one or more operations, devices, components, networks, any other type of system or any combination thereof. For purposes of this disclosure, an information handling system may include any instrumentality or aggregate of instrumentalities that are configured to or are operable to compute, classify, process, transmit, receive, retrieve, originate, switch, store, display, manifest, detect, record, reproduce, handle, or utilize any form of information, intelligence, or data for any purpose, for example, for a maritime vessel or operation. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data, instructions or both for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present invention are described in detail herein. In the interest of clarity, not all features of an actual implementation may be described in this specification. It will of course be appreciated that in the development of any such actual embodiment, numerous implementation-specific decisions may be made to achieve the specific implementation goals, which may vary from one implementation to another. Moreover, it will be appreciated that such a development effort might be complex and time consuming but would nevertheless be a routine undertaking for those of ordinary skill in the art having the benefit of the present disclosure.

The terms "couple" or "couples," as used herein are intended to mean either an indirect or direct connection. Thus, if a first device couples to a second device, that connection may be through a direct connection, or through an indirect electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connection.

FIG. 1 illustrates a well system 100 with a computing subsystem 125 for performing a treatment operation. The well system 100 includes a wellbore 105 in a subterranean formation 110 beneath a ground surface 115. As illustrated, the wellbore 105 may include a horizontal wellbore. However, a well system may include any combination of horizontal, vertical, slant, curved, or other wellbore orientations. Additionally, wellbore 105 may be disposed or positioned in a subsea environment. The well system 100 may include one or more additional treatment wells, observation wells, or other types of wells. The computing subsystem 125 may include one or more computing devices or systems located at the wellbore 105, in other locations, and combinations thereof. The computing subsystem 125, or any of its components, may be located apart from the other components shown in FIG. 1. For example, the computing subsystem 125 may be located at a data processing center, a computing facility, or another suitable location. In one or more embodiments, computing subsystem 125 may comprise one or more information handling systems, for example, information handling system 600 of FIG. 6 (described further below).

The subterranean formation 110 may include a reservoir that contains hydrocarbon resources, such as oil, natural gas, or others. For example, the subterranean formation 110 may include all or part of a rock formation (for example, shale, coal, sandstone, granite, or others) that contains natural gas. The subterranean formation 110 may include naturally fractured rock or natural rock formations that are not fractured to a significant degree. In one or more embodiments, the subterranean formation 110 may include tight gas formations that include low permeability rock (for example, shale, coal, or others).

The well system 100 may comprise an injection system 120. The injection system 120 may be used to perform an injection treatment, whereby fluid is injected into the subterranean formation 110 through the wellbore 105. In one or more embodiments, the injection treatment may fracture and/or stimulate part of a rock formation or other materials in the subterranean formation 110. In such embodiments, fracturing the rock may increase the surface area of the formation, which may increase the rate at which the formation conducts fluid resources to the wellbore 105. For example, a fracture treatment may augment the effective permeability of the rock by creating high permeability flow paths that permit native fluids (for example, hydrocarbons) to flow out of the reservoir rock into the fracture and flow through the reservoir to the wellbore 105. The injection system 120 may utilize selective fracture valve control, information on stress fields around hydraulic fractures, real time fracture mapping, real time fracturing pressure interpretation, and combinations thereof to achieve desirable complex fracture geometries in the subterranean formation 110.

A stimulation, injection, or fracture treatment may be applied at a single fluid injection location or at multiple fluid injection locations in a subterranean zone, and the fluid may be injected over a single time period or over multiple different time periods. In one or more embodiments, a fracture treatment may use multiple different fluid injection locations in a single wellbore, multiple fluid injection locations in multiple different wellbores, and any combination thereof. Moreover, the fracture treatment may inject fluid through any suitable type of wellbore, such as, for example, vertical wellbores, slant wellbores, horizontal wellbores, curved wellbores, and any combination of thereof.

The injection system 120 may inject a treatment fluid into the subterranean formation 110 from the wellbore 105. The injection system 120 may comprise one or more instrument trucks 130, one or more pump trucks 135, and an injection treatment control subsystem 140, without limitation. The injection system 120 may apply injection treatments that include, but are not limited to, a multi-stage fracturing treatment, a single-stage fracture treatment, a mini-fracture test treatment, a follow-on fracture treatment, a re-fracture treatment, a final fracture treatment, other types of fracture treatments, and any combination thereof.

The one or more pump trucks 135 may include mobile vehicles, immobile installations, skids, hoses, tubes, fluid tanks, fluid reservoirs, pumps, valves, mixers, or other types of structures and equipment. As illustrated, the pump truck 135 may comprise of an electric pump 137 disposed about the pump truck 135. In one or more embodiments, a plurality of electric pumps 137 may be utilized within the injection system 120. In one or more embodiments, the electric pump 137 may have any suitable range of revolutions per minute and may not require the use of a transmission. The electric pump 137 may be manually operated, controlled by computing subsystem 125, and combinations thereof. The design of the electric pump 137 may enable control of fracture propagation allowing growth rate to accelerate at higher injection rates, to slow at lower injection rates, and combinations thereof as electric pumps, in general, may have continuously variable rate control. For example, a pump with a variable gear ratio transmission may limit a waveform of the output of the pump due to the gear changes needed in the transmission, wherein the waveform is the shape of the output signal observed through measurements. In one or more embodiments, when a gear shift is required for conventional diesel engines and/or pumps, the transmission may operate in a torque-converting mode until the gear shift has been made and the clutch can re-engage. As a result of the gear shift, there may be a sudden increase or decrease in flow rate and/or pressure output from the pump. To maintain accurate control of the waveform of the output while taking into account the sudden increase due to a gear shift, a single gear may operate within a narrow range of revolutions per minute (RPM). This may limit the amplitude of a flow rate change or change in pressure. As disclosed, by using the electric pump 137, this may not affect the flow rate into wellbore 105.

The one or more pump trucks 135 may supply treatment fluid or one or more other materials for the injection treatment. The one or more pump trucks 135 may contain one or more treatment fluids, one or more proppant materials, any one or more other materials and any combination thereof (collectively referred to herein as "one or more fluids 143") for use in one or more stages of a stimulation treatment, and combinations thereof. The one or more pump trucks 135 may communicate the one or more fluids 143 into the wellbore 105 at or near the level of the ground surface 115 with the electric pump 137. The one or more fluids 143 are communicated through the wellbore 105 from the ground surface 115 level by a conduit 145 installed in the wellbore 105. The conduit 145 may include casing cemented to the wall of the wellbore 105. In some implementations, all or a portion of the wellbore 105 may be left open, without casing. The conduit 145 may include a working string, coiled tubing, sectioned pipe, or other types of conduit.

The one or more instrument trucks 130 may comprise a mobile vehicle, an immobile installation, any other suitable structure and any combination thereof. The one or more instrument trucks 130 may comprise the injection treatment control subsystem 140 that controls or monitors the injection treatment applied by the injection system 120. One or more instrument trucks 130 may be communicatively coupled to the one or more pump trucks 135 via one or more communication links 150. In one or more embodiments, the communications links 150 may comprise a direct or indirect, wired or wireless connection. In one or more embodiments, the one or more communication links 150 allow the injection treatment control subsystem 140 to communicate with the electric pump 137. In one or more embodiments, the one or more communication links 150 allow the injection treatment control subsystem 140 or any other component of the one or more instrument trucks 130 to communicate with other equipment at the ground surface 115. Additional communication links (not illustrated) may allow the instrument trucks 130 to communicate with sensors or data collection apparatuses in the well system 100, remote systems, other well systems, equipment installed in the wellbore 105 or other devices and equipment. In one or more embodiments, the one or more communication links 150 may allow the one or more instrument trucks 130 to communicate with the computing subsystem 125 that may be configured to run injection simulations and provide one or more treatment parameters. The well system 100 may include multiple uncoupled communication links or a network of coupled communication links.

The injection system 120 may comprise one or more sensors 153 disposed at the surface 115, downhole, and combinations thereof to measure pressure, rate, fluid density, temperature, other parameters of treatment or production and combinations thereof. For example, the one or more sensors 153 may include one or more pressure meters or other equipment that measure the pressure of one or more fluids 143 in the wellbore 105 at or near the ground surface 115 or at other locations. The injection system 120 may include one or more pump controls or other types of controls for starting, stopping, increasing, decreasing or otherwise controlling pumping as well as controls for selecting or otherwise controlling the one or more fluids 143 pumped during the injection treatment. The injection treatment control subsystem 140 may communicate with the one or more pump controls or other types of controls to monitor and control the injection treatment. The injection treatment control subsystem 140 may be communicatively coupled to the one or more sensors 153 via a communication link 150 (not illustrated).

The injection system 120 may inject the one or more fluids 143 into the subterranean formation 110 above, at, or below a fracture initiation pressure for the formation; above, at or below a fracture closure pressure for the formation; or at another fluid pressure. Fracture initiation pressure may refer to a minimum fluid injection pressure that can initiate or propagate fractures in the subterranean formation 110. Fracture closure pressure may refer to a minimum fluid injection pressure that can dilate existing fractures in the subterranean formation 110. In one or more embodiments, the fracture closure pressure may be related to the minimum horizontal stress acting on the subterranean formation 110. The net treating pressure may, in some instances, refer to a bottom hole treating pressure (for example, at one or more perforations 160) minus a fracture closure pressure or a rock closure stress. The rock closure stress may refer to the native stress in the formation that counters the fracturing of the rock.

The injection treatment control subsystem 140 may control operation of the injection system 120. The injection treatment control subsystem 140 may include data processing equipment, communication equipment, or other systems that control injection treatments applied to the subterranean formation 110 through the wellbore 105. The injection treatment control subsystem 140 may communicatively couple to the computing subsystem 125. Computing subsystem 125 may include one or more instructions or applications that when executed calculate, select, or optimize treatment parameters for initialization, propagation, or opening fractures in the subterranean formation 110. The injection treatment control subsystem 140 may receive, generate or modify an injection treatment plan (for example, a pumping schedule) that specifies one or more properties of an injection treatment to be applied to the subterranean formation 110.

In one or more embodiments, the injection treatment control subsystem 140 may interface with one or more controls of the injection system 120. For example, the injection treatment control subsystem 140 may initiate one or more control signals that configure, command or otherwise instruct the injection system 120 or other equipment (for example, a pump truck, etc.) to execute one or more aspects or operations of the injection treatment plan. In one or more embodiments, the injection treatment control subsystem 140 may initiate one or more control signals to the electric pump 137 in order to modulate the output injection flow rate of the one or more fluids 143. The injection treatment control subsystem 140 may receive data measurements collected from the subterranean formation 110 or another subterranean formation by the one or more sensors 153, and the injection treatment control subsystem 140 may process the data or otherwise use the data to select or modify properties of an injection treatment to be applied to the subterranean formation 110. The injection treatment control subsystem 140 may initiate one or more control signals that configure or reconfigure the injection system 120 or other equipment based on selected or modified properties.

In one or more embodiments, the injection treatment control subsystem 140 may control the injection treatment in real-time based on one or more measurements obtained during the injection treatment. For example and without limitation, any one or more sensors 153 may comprise of a pressure meter, a flow monitor, microseismic equipment, one or more fiber optic cables, a temperature sensor, an acoustic sensor, a tiltmeter, or any other suitable equipment may monitor the injection treatment. In one or more embodiments, observed fluid pressures may be used to determine when and in what manner to change the one or more treatment parameters to achieve pre-determined one or more fracture properties. For example, the injection treatment control subsystem 140 may control, change or both the net treating pressure of an injection treatment to improve or maximize fracture volume or connected fracture surface area. Controlling the net treating pressure may include, but is not limited to, modifying one or more pumping pressures, modifying one or more pumping rates, modifying one or more pumping volumes, modifying one or more proppant concentrations, modifying one or more fluid properties (for example, by adding or removing one or more gelling agents to adjust viscosity), using one or more diversion techniques, using one or more stress interference techniques, optimizing or otherwise adjusting spacing between one or more perforations, initiating one or more fracturing stages, or hydraulically inducing one or more fractures to control the degree of stress interference between one or more fracturing stages, or any other appropriate methods to maintain the net treating pressure within a pre-determined value or range.

As illustrated in FIG. 1, an injection treatment plan has been implemented by the injection system 120 to fracture the subterranean formation 110. The one or more fractures 155 may include one or more fractures of any length, shape, geometry or aperture, that extend from one or more perforations 160 along the wellbore 105 in any direction or orientation. The one or more fractures 155 may be formed by one or more hydraulic injections at multiple stages or intervals, at different times or simultaneously. While FIG. 1 illustrated a preferred fracture direction that is perpendicular to the wellbore 105, the present disclosure contemplates any suitable direction.

The one or more fractures 155, which are initiated by an injection treatment of the injection treatment plan, may extend from the wellbore 105 and terminate in the subterranean formation 110. The one or more fractures 155 initiated by the injection treatment may be the dominant or main fractures in the region near the wellbore 105. The one or more fractures 155 may extend through one or more regions that include one or more natural fracture networks 165, one or more regions of un-fractured rock, or both. In the illustrated embodiment, the one or more fractures 155 may intersect the one or more natural fracture networks 165. Through the dominant fracture, high pressure one or more fluids 143 may flow in the one or more natural fracture networks 165 and induce dilation of one or more natural fractures and leak-off of the one or more fluid 143 into the one or more natural fractures.

In one or more embodiments, increasing the net treating pressure (for example, above a critical or threshold pressure) may cause the fracture growth to reorient. For example, the one or more fractures 155 may begin to grow along the one or more natural fractures, in one or more directions that are not perpendicular to a minimum horizontal stress. Consequently, in an injection treatment that comprises a multi-stage fracturing treatment, reorientation of dominant fracture growth at different stages of the treatment may cause the one or more fractures 155 to intersect each other. As such, the pressure signature associated with intersecting one or more fractures 155 may be used to optimize or otherwise modify fracture spacing, perforation spacing, or one or more other factors to minimize or otherwise reduce the likelihood of fracture reorientation.

In one or more embodiments, the injection treatment may be designed to produce generally one or more parallel, non-intersecting dominant fractures (for example, the one or more fractures 155 shown in FIG. 1). For example, computer modeling and numerical simulations may be used to determine the maximum net treating pressure required to produce a desired fracture growth orientation. Other factors, such as but not limited to connected fracture surface area, fracture volume, production volume, and combinations thereof may be considered in selecting a target net treating pressure.

The computing subsystem 125 may be configured to operate the electric pump 137, wherein the computing subsystem 125 may be programmed with a suitable algorithm, software application or one or more executable instructions to modulate the injection rate during a hydraulic fracture treatment to control one or more aspects of fracture growth. In one or more embodiments, the computing subsystem 125 may instruct the electric pump 137 to adjust or alter the injection flow rate to effectively produce simple and planar fracture growth, complex and branched fracture growth, and combinations thereof. The fracture growth parameters may be alternated at any time during a fracture treatment process, wherein the fracture growth parameters are parameters that determine whether a fracture will grow with simple and planar geometry or with more complex geometry by dilating and opening secondary fractures that intersect with a primary fracture. One of the means of controlling fracture growth parameters may be changing the net treating pressure with reference to the maximum horizontal stress. In one or more embodiments, if the net treating pressure exceeds the difference between the maximum horizontal stress and the minimum horizontal stress, then potential fractures may propagate with more complex geometry.

Modulating the injection rate may be used to perform real-time pressure diagnostics regarding the wellbore 105. In one or more embodiments, amplitude, frequency, and combinations thereof of the injection rate may be varied, for example, according to an injection treatment plan, to modulate the flow rate of the electric pump 137. With variability of the injection flow rate, a phase of an input function may be controlled relative to a phase of a response of the subterranean formation 110. In one or more embodiments, the input function to be controlled is the injection flow rate which has a given rate function (described further below) that can be observed for a response in pressure. In one of the one or more embodiments, the injection flow rate may be stepped down in three steps, each of sufficient duration to allow the pressure to stabilize in response before moving to the subsequent step. In this embodiment, the pressure drop for each rate step may be a function of pipe friction, perforation friction, tortuosity friction, and wellbore friction (each described further below with Equation 1). Each of these potential causes may have a different rate function associated to them, so it may be possible to separate these different values and determine the primary cause of a given change in pressure. Excessive perforation friction suggests that there may be insufficient perforations 160 to support the desired flow rate. Excessive tortuosity friction suggests that fracture complexity may restrict fracture width in the near-wellbore area. Excessive wellbore friction suggests that additional chemical friction reducing agents may be required for operations.

In one or more embodiments, one or more rate functions may be incorporated into an injection treatment plan monitored by the computing subsystem 125, wherein the rate function is the mode of rate of change or modulation. In one or more embodiments, the one or more rate functions may include changes in amplitude, frequency, function of the change in rate, and combinations thereof. Without limitations, the change in function may be a near instantaneous change in rate, a step function change in rate with a plurality of step changes, a linear function change over a time period, a given mathematical function to increase or decrease flow rate over a time period, and combinations thereof. The computing subsystem 125 may correlate the one or more rate functions to the pressure used in a treatment to establish or determine if growth of a fracture is occurring above the maximum horizontal stress. As the rate functions affect the flow rate of the electric pump 137, dilation and propagation of one or more secondary fractures may occur, wherein the one or more secondary fractures may result from dilation of existing one or more natural fractures (for example, one or more natural fracture networks 165), one or more leak-off induced fractures propagating away from the main fracture (for example, fracture 155), and combinations thereof.

Without limitations, modulation of the flow rate may be used to improve fracture complexity, in one or more step rate tests, in step down tests, in diverter deployment, and combinations thereof. In one or more embodiments related to improving fracture complexity, modulating the flow rate may occur in cycles of short duration to achieve increased microseismic activity, wherein the microseismic activity is correlated to increased fracture complexity. Without limitations, the each one of the cycles of short duration may be about less than one minute. In these embodiments, the flow rate may be increased until the pressure is greater than a maximum horizontal stress, wherein the maximum horizontal stress is already determined. As the flow rate increases, the fracture complexity may be enhanced or increased as well. During this transitional period of time, microproppants may be pumped downhole to stimulate secondary fractures. After a predetermined period of time, volume of fluid, and combinations thereof, the flow rate may be decreased until the pressure is lower than the maximum horizontal stress. As the pressure decreases, the secondary fractures may close onto the microproppants injected downhole, thereby allowing the fracture 155 to continue to propagate at a lower treating pressure. This process may be repeated a plurality of times to generate further complexity along the main fractures 155.

Figure 2A:
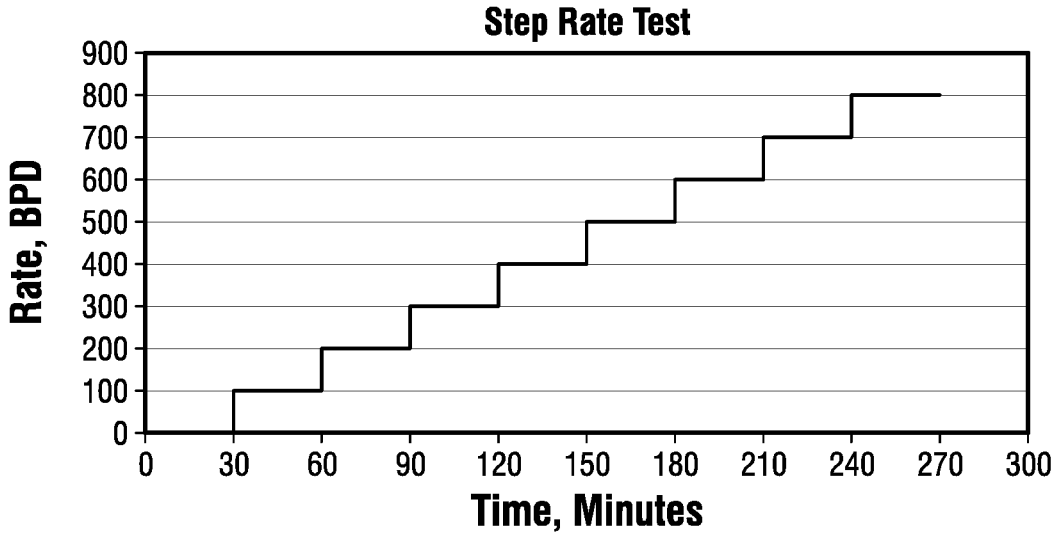
FIG. 2A illustrates a graph for a step rate test, in accordance with one or more embodiments of the present disclosure.
Figure 2B:
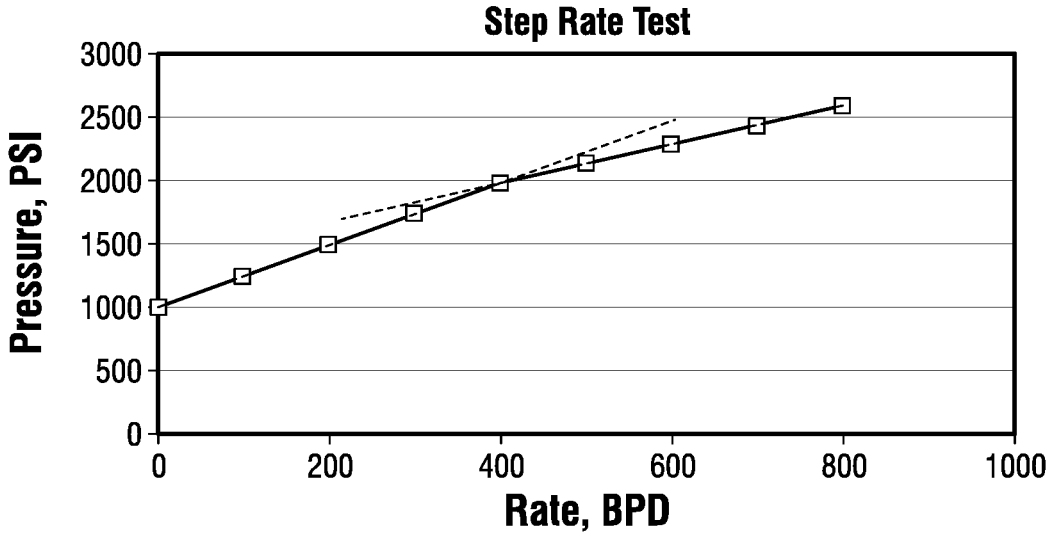
FIG. 2B illustrates a graph for a step rate test, in accordance with one or more embodiments of the present disclosure.

In one or more embodiments, step rate tests may be conducted by modulating the flow rate of the electric pump 137, as illustrated in FIGS. 2A and 2B. One or more step rate tests may be conducted to determine a fracture extension pressure, wherein the fracture extension pressure is the pressure at which a fracture has been initiated and would start to further propagate. In these embodiments, the flow rate of the electric pump 137 may be at an initial value. The electric pump 137 (referring to FIG. 1) may be actuated to increase the flow rate of the electric pump 137 in stepped increments, wherein the stepped increments may be any suitable numeric value. The flow rate of the electric pump 137 may be increased up to a predetermined maximum flow rate, as illustrated in FIG. 2A. As the flow rate of the electric pump 137 increases, the computing subsystem 125 (referring to FIG. 1) may be recording one or more pressure measurements correlated to the flow rate. The computing subsystem 125 may determine a slope inflection point, wherein the slope inflection point is the data point wherein the rate of pressure to flow rate of the electric pump 137 has changed when compared to a previous value, as illustrated in FIG. 2B. In one or more embodiments, the slope inflection point may be the point wherein the pressure decreases quickly. The slop inflection point may display the fracture extension pressure.

In one or more embodiments, the one or more step down tests may be conducted in a similar manner as to the one or more step rate tests. In these embodiments, the flow rate of the electric pump 137 may be at an initial value. The electric pump 137 (referring to FIG. 1) may be actuated to decrease the flow rate of the electric pump 137 in stepped increments. As the flow rate of the electric pump 137 decreases, the computing subsystem 125 (referring to FIG. 1) may be recording pressure measurements correlated to the flow rate of the electric pump 137 once the pressure stabilizes. The computing subsystem 125 may fit the curve of Equation 1 a to the plotted data of the pressure versus the flow rate.

$$P = aQ^{\frac{1}{2}} + \beta Q^2 + P_0 \tag{1}$$

In Equation 1, the variables of a, β, and $P_0$ may be defined as a tortuosity loss coefficient, a perforation pressure loss coefficient, and the friction of the wellbore 105 (referring to FIG. 1), respectively. The term $$aQ^{\frac{1}{2}}$$

may be defined as the pressure drop in a near-wellbore area due to tortuosity friction, and $\beta Q^2$ may be defined as the perforation friction.

In one or more embodiments, the computing subsystem 125 (referring to FIG. 1) may determine the pumping schedule for an optimal diverter placement, wherein the pumping schedule is a designated plan of flow rates over time. Once the pumping schedule is determined, the computing subsystem 125 may actuate the electric pump 137 (referring to FIG. 1) in accordance with the pumping schedule. In these embodiments, the flow rate may be modulated to ensure that a diverter (not illustrated) approaches and/or enters a desired perforation interval. This may be achieved by making fractures 155 (referring to FIG. 1) more dominant by adjusting the flow rate downward to transition flow away from secondary fractures and maintain more flow rate into the dominant fractures 155. By modulating the injection flow rate, individual clusters of perforations 160 (referring to FIG. 1) may be targeted with one or more diverters.

Figure 3:
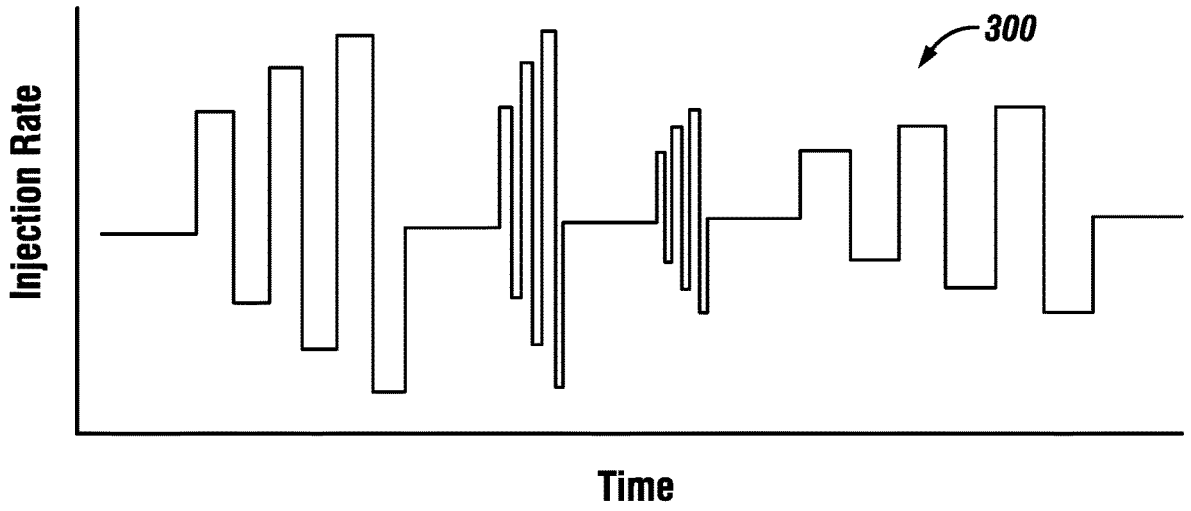
FIG. 3 illustrates a graph with a square rate function, in accordance with one or more embodiments of the present disclosure.
Figure 4:
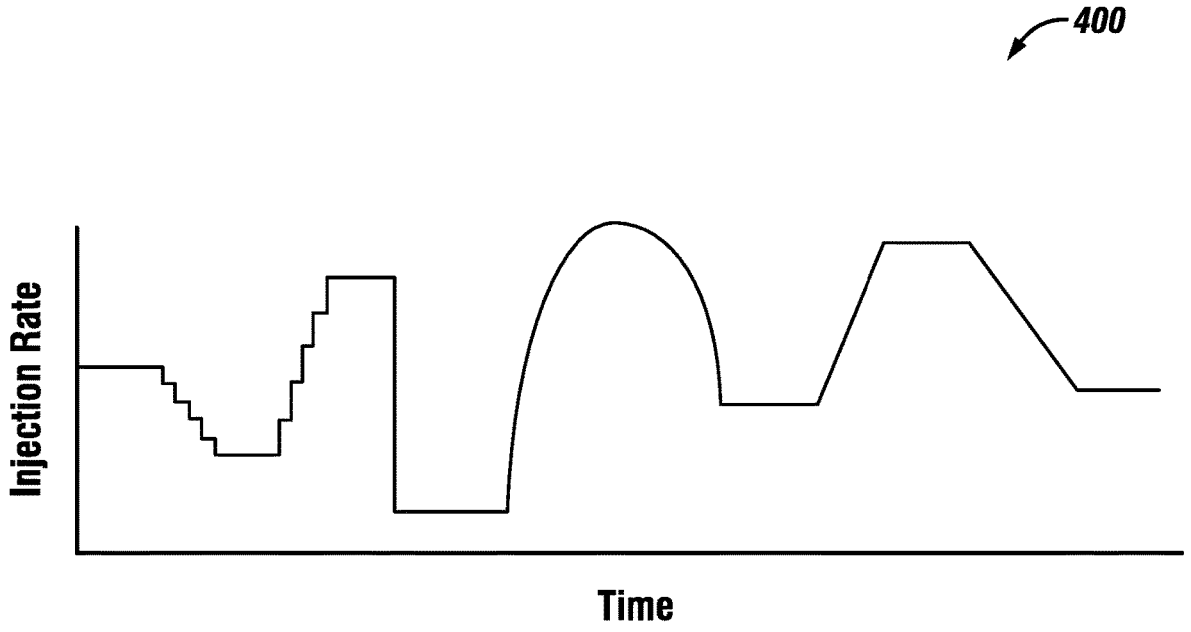
FIG. 4 illustrates a graph with varying rate functions, in accordance with one or more embodiments of the present disclosure.
Figure 5:
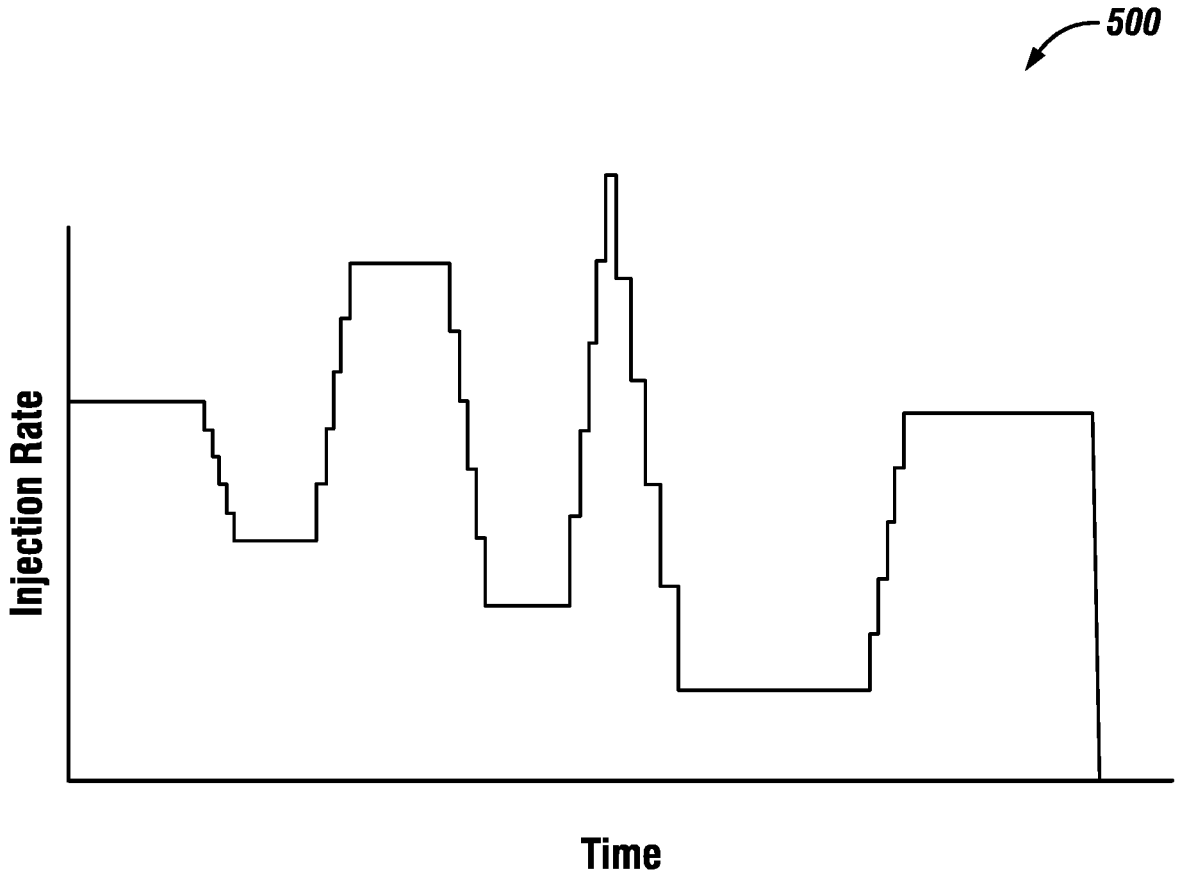
FIG. 5 illustrates a graph with multiple step rate and step down tests, in accordance with one or more embodiments of the present disclosure.

FIGS. 3-5 illustrate graphs of example modulations of the electric pump 137 (referring to FIG. 1). FIG. 3 illustrates a graph 300 of a simply square rate function being modulated. As illustrated, the computer subsystem 125 (referring to FIG. 1) may actuate the electric pump 137 to vary the amplitude, frequency, and combinations thereof. FIG. 4 illustrates a graph 400 of different rate functions being modulated. As illustrated, the injection rate may have a square rate function at an initial position. In one or more embodiments, the computer subsystem 125 may actuate the electric pump 137 to change the rate function to any other suitable rate function, including, but not limited to, a polynomial rate function, a linear rate function, and combinations thereof. In addition to varying the rate functions, the computer subsystem 125 may actuate the electric pump 137 to vary the amplitude, frequency, and combinations thereof of the injection rate. FIG. 5 illustrates a graph 500 wherein multiple step rate tests and step down tests are performed. Each step rate or step down test may comprise of modulating the injection rate in stepped increments. The modulation may occur by varying the amplitude, frequency, or both of the injection rate.

In each of the foregoing embodiments as illustrated in FIGS. 3-5, the different amplitudes of the rate functions may be used to evaluate fracture growth parameters based on the separation of perforation friction and tortuosity friction to determine the actual net treating pressure within the fracture 155 (referring to FIG. 1). Changing the rate function may be performed to try to separate different parameters, such as perforation friction and near-wellbore tortuosity. The control for changing rate in exact increments may reduce the uncertainty in separating the perforation friction and tortuosity friction. If there is a gear shift during the rate change for a given pump, then the pressure decline may not as closely match the perforation friction equation and tortuosity friction equation for near-wellbore tortuosity. This may be avoided by using the electric pump 137 (referring to FIG. 1) as the electric pump 137 does not require gear shifts.

In one or more embodiments, the frequency of the rate functions may be utilized for multiple purposes. One example purpose may be to utilize the natural frequency of the wellbore 105 (referring to FIG. 1) and the frequency of rate modulation to target specific well depths for potential wave interference from reflected waves and pumping waves to create high magnitude pressure pulses within the wellbore 105. The frequencies may be varied to target different depths that may correspond to different perforated intervals to enable improved perforation breakdown to be achieved.

In other embodiments, pressure monitoring may be performed in offset wellbores to detect fracture communication between different wells and a treatment well. There may be limited information regarding the poroelastic response or direct pressure communication between wells. In one or more embodiments, the direct pressure communication may be the detection of a pressure change in a treatment well from an offset well. The modulation of the flow rate in both amplitude and frequency may assess the communication between wells by examining the buffering that may occur within a system of fractures 155 (referring to FIG. 1). In one or more embodiments, buffering may either be the attenuation of the amplitude of a signal or the changes in the phases between the signal at a treatment well and a offset well. The degree of buffering may be directly related to the degree of communication.

Figure 6:
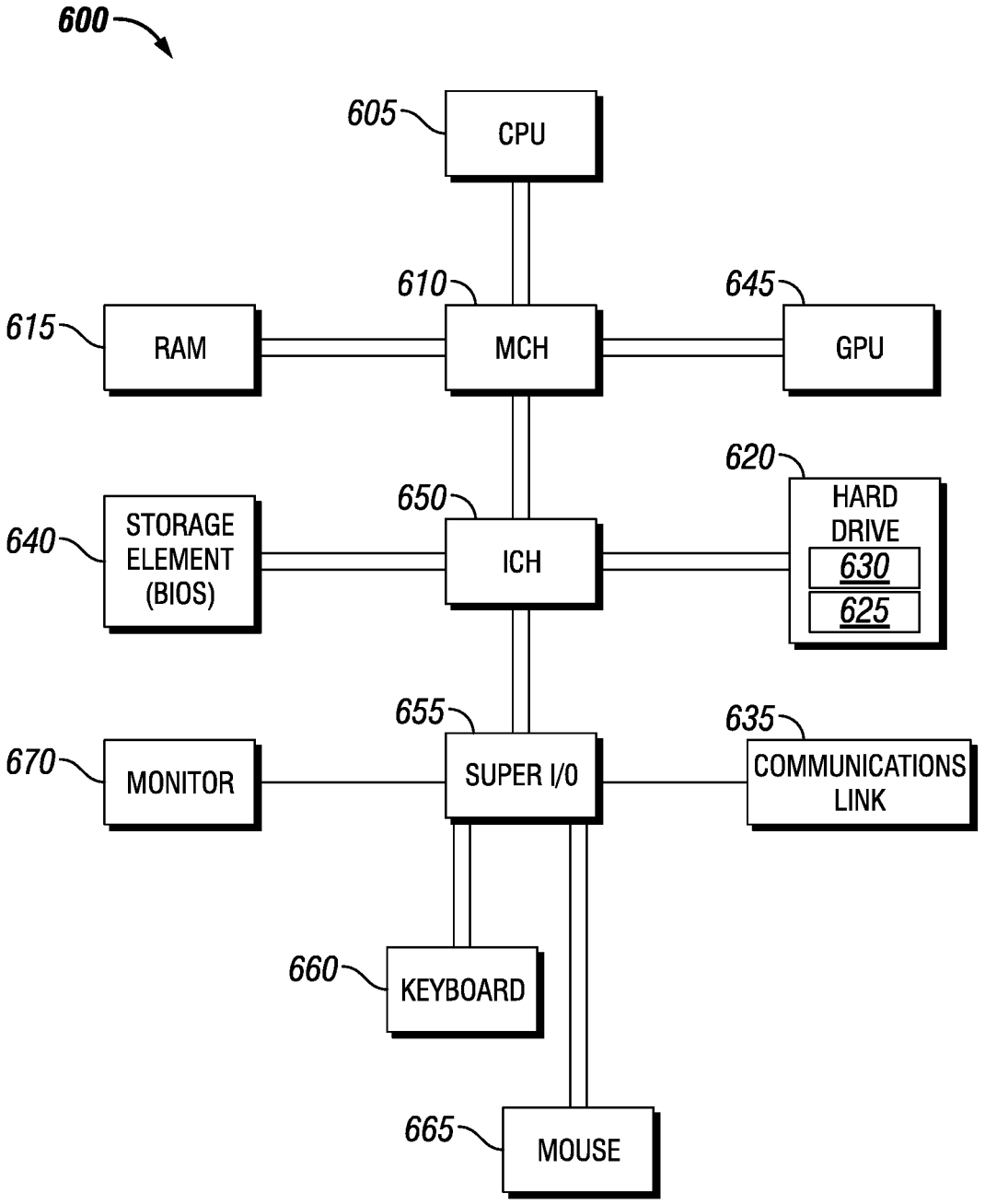
FIG. 6 illustrates a schematic diagram of an information handling system for a well system, in accordance with one or more embodiments of the present disclosure.

FIG. 6 is a diagram illustrating an example information handling system 600, for example, for use with or by an associated well system 100 of FIG. 1, according to one or more aspects of the present disclosure. The computing subsystem 125 of FIG. 1 may take a form similar to the information handling system 600. A processor or central processing unit (CPU) 605 of the information handling system 600 is communicatively coupled to a memory controller hub (MCH) or north bridge 610. The processor 605 may include, for example a microprocessor, microcontroller, digital signal processor (DSP), application specific integrated circuit (ASIC), or any other digital or analog circuitry configured to interpret and/or execute program instructions and/or process data. Processor 605 may be configured to interpret and/or execute program instructions or other data retrieved and stored in any memory such as memory 615 or hard drive 620. Program instructions or other data may constitute portions of a software or application, for example application 625 or data 630, for carrying out one or more methods described herein. Memory 615 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 625 or data 630 may be retrieved and stored in memory 615 for execution or use by processor 605. In one or more embodiments, the memory 615 or the hard drive 620 may include or comprise one or more non-transitory executable instructions that, when executed by the processor 605, cause the processor 605 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 630 may include treatment data, geological data, fracture data, microseismic data, or any other appropriate data. The one or more applications 625 may include a fracture design model, a reservoir simulation tool, a fracture simulation model, or any other appropriate applications. In one or more embodiments, a memory of a computing device includes additional or different data, application, models, or other information. In one or more embodiments, the data 630 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 630 may include geological data relating to one or more geological properties of the subterranean formation 110 (referring to FIG. 1). For example, the geological data may include information on the wellbore 105 (referring to FIG. 1), completions, or information on other attributes of the subterranean formation 110. In one or more embodiments, the geological data includes information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 630 include fracture data relating to fractures in the subterranean formation 110. The fracture data may identify the locations, sizes, shapes, and other properties of fractures in a model of a subterranean zone. The fracture data can include information on natural fractures, hydraulically-induced fractures, or any other type of discontinuity in the subterranean formation 110. The fracture data can include fracture planes calculated from microseismic data or other information. For each fracture plan, the fracture data can include information (for example, strike angle, dip angle, etc.) identifying an orientation of the fracture, information identifying a shape (for example, curvature, aperture, etc.) of the fracture, information identifying boundaries of the fracture, or any other suitable information.

The one or more applications 625 may comprise one or more software applications, one or more scripts, one or more programs, one or more functions, one or more executables, or one or more other modules that are interpreted or executed by the processor 605. For example, the one or more applications 625 may include a fracture design module, a reservoir simulation tool, a hydraulic fracture simulation model, or any other appropriate function block. The one or more applications 625 may include machine-readable instructions for performing one or more of the operations related to any one or more embodiments of the present disclosure. The one or more applications 625 may include machine-readable instructions for generating a user interface or a plot, for example, illustrating fracture geometry (for example, length, width, spacing, orientation, etc.), pressure plot, hydrocarbon production performance. The one or more applications 625 may obtain input data, such as treatment data, geological data, fracture data, or other types of input data, from the memory 615, from another local source, or from one or more remote sources (for example, via the one or more communication links 635). The one or more applications 625 may generate output data and store the output data in the memory 615, hard drive 620, in another local medium, or in one or more remote devices (for example, by sending the output data via the communication link 635).

Modifications, additions, or omissions may be made to FIG. 6 without departing from the scope of the present disclosure. For example, FIG. 6 shows a particular configuration of components of information handling system 600. However, any suitable configurations of components may be used. For example, components of information handling system 600 may be implemented either as physical or logical components. Furthermore, in some embodiments, functionality associated with components of information handling system 600 may be implemented in special purpose circuits or components. In other embodiments, functionality associated with components of information handling system 600 may be implemented in configurable general-purpose circuit or components. For example, components of information handling system 600 may be implemented by configured computer program instructions.

Memory controller hub 610 may include a memory controller for directing information to or from various system memory components within the information handling system 600, such as memory 615, storage element 640, and hard drive 620. The memory controller hub 610 may be coupled to memory 615 and a graphics processing unit (GPU) 645. Memory controller hub 610 may also be coupled to an I/O controller hub (ICH) or south bridge 650. I/O controller hub 650 is coupled to storage elements of the information handling system 600, including a storage element 640, which may comprise a flash ROM that includes a basic input/output system (BIOS) of the computer system. I/O controller hub 650 is also coupled to the hard drive 620 of the information handling system 600. I/O controller hub 650 may also be coupled to an I/O chip or interface, for example, a Super I/O chip 655, which is itself coupled to several of the I/O ports of the computer system, including a keyboard 660, a mouse 665, a monitor 670 and one or more communications link 635. Any one or more input/output devices receive and transmit data in analog or digital form over one or more communication links 635 such as a serial link, a wireless link (for example, infrared, radio frequency, or others), a parallel link, or another type of link. The one or more communication links 635 may comprise any type of communication channel, connector, data communication network, or other link. For example, the one or more communication links 635 may comprise a wireless or a wired network, a Local Area Network (LAN), a Wide Area Network (WAN), a private network, a public network (such as the Internet), a WiFi network, a network that includes a satellite link, or another type of data communication network.

An embodiment of the present disclosure is A method of stimulating a wellbore, comprising: injecting, by an electric pump, one or more fluids downhole into the wellbore; producing, based, at least in part, on the one or more injected fluids, one or more fractures that extend from the wellbore into a subterranean formation; receiving, by one or more sensors, one or more measurements; modulating an injection flow rate of the one or more injected fluids to alter one or more fracture growth parameters of the one or more fractures; evaluating the one or more fracture growth parameters of the one or more fractures; and adjusting fracture complexity of the one or more fractures based on the evaluation of the one or more fracture growth parameters.

In one or more embodiments described in the preceding paragraph, wherein modulating the injection flow rate comprises of varying the amplitude of the injection flow rate. In one or more embodiments described above, wherein modulating the injection flow rate comprises of varying the frequency of the injection flow rate. In one or more embodiments described above, wherein modulating the injection flow rate comprises of varying a rate function of the injection flow rate, wherein the rate function is the mode of the rate of modulation. In one or more embodiments described above, wherein the rate function is a near instantaneous change in rate, a step function change in rate with a plurality of step changes, a linear function change over a time period, a mathematical function to increase or decrease injection flow rate over a time period, and combinations thereof. In one or more embodiments described above, the method further comprising performing a step rate test to determine a fracture extension pressure, wherein the fracture extension pressure is the pressure at which a fracture of the one or more fractures has been initiated. In one or more embodiments described above, wherein modulating the injection flow rate comprises of increasing the injection flow rate in stepped increments. In one or more embodiments described above, the method further comprising performing a step down test. In one or more embodiments described above, wherein modulating the injection flow rate comprises of decreasing the injection flow rate in stepped increments. In one or more embodiments described above, wherein adjusting fracture complexity of the one or more fractures comprises of increasing fracture complexity of the one or more fractures by modulating the injection flow rate to be above a maximum horizontal stress of the subterranean formation. In one or more embodiments described above, wherein modulating the injection flow rate occurs in cycles of short duration, wherein the cycles of short duration are about less than one minute. In one or more embodiments described above, the method further comprising performing real-time pressure diagnostics with regards to the wellbore, wherein the one or more sensors are communicatively coupled to a computing subsystem. In one or more embodiments described above, wherein the computing subsystem evaluates the one or more fracture growth parameters in relation to $$P = aQ^{\frac{1}{2}} + \beta Q^2 + P_0,$$

wherein a is a tortuosity loss coefficient, β is a perforation pressure loss coefficient, and $P_0$ is the friction of the wellbore. In one or more embodiments described above, wherein evaluating the one or more fracture growth parameters is based on the separation of perforation friction and tortuosity friction with the computing subsystem to determine the net treating pressure within the one or more fractures.

Another embodiment of the present disclosure is an injection system, comprising: an electric pump, wherein the electric pump is configured to pump one or more fluids into a wellbore at an injection flow rate; one or more sensors; and an injection treatment control subsystem, wherein the injection treatment control subsystem is communicatively coupled to the electric pump and the one or more sensors via one or more communication links, wherein the injection treatment control subsystem is configured to: receive measurements from the one or more sensors; modulate the injection flow rate of the one or more fluids; evaluate fracture growth parameters of one or more fractures produced by the one or more fluids; and adjust fracture complexity of the one or more fractures based on the evaluation of the fracture growth parameters.

In one or more embodiments described in the preceding paragraph, the injection system further comprising a conduit installed within the wellbore. In one or more embodiments described above, wherein the conduit comprises one or more perforations. In one or more embodiments described above, wherein the one or more sensors are disposed about a surface of the wellbore, downhole within the wellbore, and combinations thereof. In one or more embodiments described above, wherein the injection treatment control subsystem is configured to perform a step rate test to determine a fracture extension pressure, wherein the fracture extension pressure is the pressure at which a fracture of the one or more fractures has been initiated. In one or more embodiments described above, wherein the injection treatment control subsystem is configured to evaluate the fracture growth parameters in relation to $$P = aQ^{\frac{1}{2}} + \beta Q^2 + P_0,$$

wherein a is a tortuosity loss coefficient, β is a perforation pressure loss coefficient, and $P_0$ is the friction of the wellbore.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. While numerous changes may be made by those skilled in the art, such changes are encompassed within the spirit of the subject matter defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. In particular, every range of values (for example, "from about a to about b," or, equivalently, "from approximately a to b," or, equivalently, "from approximately a-b") disclosed herein is to be understood as referring to the power set (the set of all subsets) of the respective range of values. The terms in the claims have their plain, ordinary meaning unless otherwise explicitly and clearly defined by the patentee.

What is claimed is:

1. A method of stimulating a wellbore, comprising:

injecting, by an electric pump, one or more fluids downhole into the wellbore;

producing, based, at least in part, on the one or more injected fluids, one or more fractures that extend from the wellbore into a subterranean formation;

receiving, by one or more sensors, one or more measurements;

modulating an injection flow rate of the one or more injected fluids to alter one or more fracture growth parameters of the one or more fractures, wherein modulating the injection flow rate occurs in cycles of short duration, wherein the cycles of short duration are less than about one minute;

evaluating the one or more fracture growth parameters of the one or more fractures; and adjusting fracture complexity of the one or more fractures based on the evaluation of the one or more fracture growth parameters, wherein adjusting fracture complexity of the one or more fractures comprises of increasing the fracture complexity of the one or more fractures by modulating the injection flow rate to produce a pressure to be above a maximum horizontal stress of the subterranean formation.

2. The method of claim 1, wherein modulating the injection flow rate comprises of varying the amplitude of the injection flow rate.

3. The method of claim 1, wherein modulating the injection flow rate comprises of varying the frequency of the injection flow rate.

4. The method of claim 1, wherein modulating the injection flow rate comprises of varying a rate function of the injection flow rate, wherein the rate function is the mode of the rate of modulation.

5. The method of claim 4, wherein the rate function is a near instantaneous change in rate, a step function change in rate with a plurality of step changes, a linear function change over a time period, a mathematical function to increase or decrease injection flow rate over a time period, and combinations thereof.

6. The method of claim 4, further comprising performing a step rate test to determine a fracture extension pressure, wherein the fracture extension pressure is the pressure at which a fracture of the one or more fractures has been initiated.

7. The method of claim 6, wherein modulating the injection flow rate comprises of increasing the injection flow rate in stepped increments.

8. The method of claim 4, further comprising performing a step down test.

9. The method of claim 8, wherein modulating the injection flow rate comprises of decreasing the injection flow rate in stepped increments.

10. The method of claim 1, further comprising performing real-time pressure diagnostics with regards to the wellbore, wherein the one or more sensors are communicatively coupled to a computing subsystem.

11. The method of claim 10, wherein the computing subsystem evaluates the one or more fracture growth parameters in relation to $$P = aQ^{\frac{1}{2}} + \beta Q^2 + P_0,$$

wherein P represents pressure, wherein a represents flow rate, wherein a is a tortuosity loss coefficient, β is a perforation pressure loss coefficient, and $P_0$ is the friction of the wellbore.

12. An injection system, comprising:

an electric pump, wherein the electric pump is configured to pump one or more fluids into a wellbore at an injection flow rate;

one or more sensors; and an injection treatment control subsystem, wherein the injection treatment control subsystem is communicatively coupled to the electric pump and the one or more sensors via one or more communication links, wherein the injection treatment control subsystem is configured to:

receive measurements from the one or more sensors;

modulate the injection flow rate of the one or more fluids in cycles of short duration, wherein the cycles of short duration are less than about one minute;

evaluate fracture growth parameters of one or more fractures produced by the one or more fluids; and adjust fracture complexity of the one or more fractures based on the evaluation of the fracture growth parameters, wherein the injection treatment control subsystem is configured to adjust fracture complexity by increasing the fracture complexity of the one or more fractures by modulating the injection flow rate to produce a pressure to be above a maximum horizontal stress of the subterranean formation.

13. The injection system of claim 12, further comprising a conduit installed within the wellbore.

14. The injection system of claim 13, wherein the conduit comprises one or more perforations.

15. The injection system of claim 13, wherein the one or more sensors are disposed about a surface of the wellbore, downhole within the wellbore, or combinations thereof.

16. The injection system of claim 12, wherein the injection treatment control subsystem is configured to perform a step rate test to determine a fracture extension pressure, wherein the fracture extension pressure is the pressure at which a fracture of the one or more fractures has been initiated.

17. The injection system of claim 12, wherein the injection treatment control subsystem is configured to evaluate the fracture growth parameters in relation to $$P = aQ^{\frac{1}{2}} + \beta Q^2 + P_0,$$

wherein P represents pressure, wherein a represents flow rate, wherein a is a tortuosity loss coefficient, β is a perforation pressure loss coefficient, and $P_0$ is the friction of the wellbore.

18. The injection system of claim 12, wherein the injection treatment control subsystem is configured to modulate the injection flow rate of the one or more fluids by varying the amplitude of the injection flow rate, varying the frequency of the injection flow rate, varying a rate function of the injection flow rate, wherein the rate function is the mode of the rate of modulation, or combinations thereof.

19. The injection system of claim 12, further comprising a computing subsystem, wherein the computing subsystem is communicatively coupled to the injection treatment control subsystem via one or more communication links.

20. The injection system of claim 19, wherein the computing subsystem is configured to determine a pumping schedule for placement of a diverter, wherein the pumping schedule is a designated plan of injection flow rates over time, wherein the computing subsystem is further configured to actuate the electric pump to operate according to the pumping schedule.

* * * * *